United States Patent [19]

Pickering

[11] 4,039,269

[45] Aug. 2, 1977

[54] FLEXIBLE TUBE PUMP HAVING LINEAR CAM ACTUATION OF DISTRIBUTOR MEANS

[75] Inventor: Norman C. Pickering, North Haven, N.Y.

[73] Assignee: The Lynkeus Corporation, East Hampton, N.Y.

[21] Appl. No.: 650,181

[22] Filed: Jan. 19, 1976

[51] Int. Cl.[2] ..... F04B 43/12; F04B 45/06; F04B 7/00

[52] U.S. Cl. ..... 417/475; 417/510

[58] Field of Search ..... 417/474, 475, 510; 74/567, 110; 92/13.2; 222/214; 128/214 F, DIG. 3

[56] References Cited

U.S. PATENT DOCUMENTS

| | | | |
|---|---|---|---|
| 1,871,692 | 8/1932 | Howard | 74/567 |
| 2,308,974 | 1/1943 | Harper | 417/510 |
| 2,412,397 | 12/1948 | Harper | 417/474 |
| 2,877,714 | 3/1959 | Sorg et al. | 417/475 |
| 2,922,379 | 1/1960 | Schultz | 417/475 |
| 3,128,716 | 4/1964 | Stallman et al. | 417/474 |
| 3,171,360 | 3/1965 | Walton | 417/474 |
| 3,314,371 | 4/1967 | Hopkinson | 417/474 |
| 3,595,134 | 7/1971 | Butterworth | 91/321 |

*Primary Examiner*—Carlton R. Croyle
*Assistant Examiner*—Thomas I. Ross
*Attorney, Agent, or Firm*—Bauer, Amer & King

[57] ABSTRACT

A precision metering and dispensing pump of the peristaltic type is disclosed. The pump includes a housing in which an elongated, compressible fluid extruding tube is disposed. The tube has an outlet that is adapted to be connected to the source of fluid that is to be pumped. Spaced serially along the tube and in opposition thereto are an inlet plunger, an extruder plunger and an outlet plunger all of which constitute valves and which are arranged to be displaced in such a manner as to apply compressive forces to the tube. A linear actuator is mounted on the housing and is coupled to a primary, two-part cam that is arranged to linearly displace the inlet and the outlet plungers at preselected times. Displacement of the primary cam causes the displacement of a secondary cam to the movement of which is responsive the extruder plunger. The primary cam acts on the outlet plunger which, at the beginning of the cycle is extended so as to close the tube. Fluid will flow into the tube up to the point where the outlet plunger has sealed the tube. Further movement of the primary cam will cause the inlet plunger to close the tube so that the fluid to be pumped is trapped between the inlet plunger and outlet plunger. Still further movement of the primary cam in the same direction will cause the secondary cam to move and thereby displace the extruder plunger while at the same time retracting the outlet plunger so that the fluid passage to the outlet is opened thereby completing the cycle after which the actuator is reversed and the cycle is repeated.

5 Claims, 7 Drawing Figures

FLEXIBLE TUBE PUMP HAVING LINEAR CAM ACTUATION OF DISTRIBUTOR MEANS

The aforementioned Abstract is neither intended to define the invention of the application which, of course, is measured by the claims, nor is it intended to be limiting as to the scope of the invention in any way.

BACKGROUND OF THE INVENTION

1. Field of the Invention

This invention relates generally to the art of pumps and more particularly to a peristaltic pump.

2. Description of the Prior Art

Peristaltic pumps, of the type to which the present invention is directed, have wide and varied applications. For example, the pump may be used for dispensing drugs or the like. In such an application it is necessary that the pump have a wide range of adjustment in order to vary the rate of flow which must be accurately determined and calibrated. The pump must be free of internal valves and other parts which create a problem of cleaning and sterilization. The pump must be capable of being put into operation quickly and easily without complicated connections and adjustments. For reliability in operation the pump must be of simple construction with a minimum number of working parts. Pumps of this type may be used for controlling the flow and composition of a fluid mixture in operation that requires delivery of a fluid having a flow that is constantly metered and whose composition is regulated within very narrow tolerances. It is also necessary in some of these applications to continuously or periodically change the composition of the fluid. Thus, with continuous change in composition, it is possible to provide a fluid stream, the composition of which can be made to vary over an entire spectrum of compositions. Industrial applications for such a device include those instances where fluid reactant compositions must be metered and their composition must be programmed over a given period.

One of the well-known types of peristaltic pumps utilizes cyclic deformation of a flexible wall tube by means of rotary cams. However, with these prior art pumps it is not usually possible to vary the output thereof over a wide range unless the speed of rotation of the cams is changed and this is difficult, particularly where AC motors are used for driving the cams. One means for overcoming this particular prior art problem is disclosed in U.S. Pat. No. 3,658,445 granted to Pulman et al. The pump of the Pulman et al patent includes a reciprocating element which alternately pinches and releases a flexible wall tube. On either side of the pumping element, reciprocating inlet and outlet closure elements are provided. When the pumping element pinches a tube during a pumping stroke the inlet closure element closes the tube while the outlet closure element releases the tube. During induction strokes, as the pumping element releases the tube, the inlet closure element is opened while the outlet element is closed. Synchronized operation of the pumping element, as well as the inlet and outlet elements, is achieved by associated cams. However, it should be noted that the movement of the associated cams is perpendicular to that of the linear actuator.

However, in contrast to the present invention which will be described fully hereinafter, the Pulman et al. disclosure does not teach the opening and closing of the inlet and outlet closure elements in timed relationship with each other as well as in timed relationship with the pumping element. In the Pulman et al. patent, the pump is provided with means for varying the stroke of the pumping element so as to vary the pump output. This, too, is in contrast to the structure and method of operation of the present invention. The present invention is further distinguished over the Pulman et al. structure in that, as will be described hereinafter, a single, primary, two-part cam is used for both the inlet and outlet elements while a secondary cam, responsive to the movement of the primary cam is used for the pumping element.

U.S. Pat. No. 3,359,910 granted to Lapham, Jr. discloses another form of peristaltic pump. In the Lapham, Jr. patent, the peristaltic-like fluid pump utilizes a flexible tube in combination with inlet and outlet valves which are under the control of the rotation of a cam. Cam driven actuating means associated with the inlet and outlet valves are adapted to alternately actuate force applying means such that external force is applied when the outlet valve means is open. The external force is released when the inlet valve is open. The cam driven actuating means associated with the valve means is mechanically connected to the actuating means through reduction gears so that the cam driven actuating means may operate at a predetermined speed. As will be explained more fully hereinafter, the present invention provides different structure for regulating the flow of fluid.

U.S. Pat. No. 3,007,416 granted to Childs is related to fluid pumps of the type that are capable of simulating the action of a human heart in pumping blood through the human system. The Childs' pump utilizes a flexible element of readily deformable material having a passage for passing fluid. The flexible element is positioned in a housing such that it extends through and divides the housing into separate chambers. One end of the flexible element is adapted to be connected to a suitable source of fluid and the other end is connected to a receiver for the fluid. The chambers are adapted to be connected to a source providing positive and negative pressures such that the pressures are applied to portions of the element in predetermined sequence to produce flow of the fluid through the element. However, there is no suggestion in the Childs' patent for the timed actuation of separate inlet plunger means, outlet plunger means and extruder plunger means such as contemplated by the present invention and as will be described more fully hereinafter.

Still another form of prior art pump is diclosed in U.S. Pat. No. 2,412,397 granted to Harper, in which there is disclosed a pump comprising a flexible walled pump chamber with which is associated a flexible walled inlet valve and a flexible walled outlet valve. Means are also provided for compressing or squeezing the walls of the valves and the pump chamber in order to obtain a movement of fluid from an inlet connection to a discharge connection. The Harper patent provides means for squeezing or compressing the tubular member to seal off portions thereof in order to provide inlet and outlet valve means and for varying the capacity of a portion thereof in order to produce a pumping action by a movement transversely of a length of the tubular member without any longitudinal component to such movement. The structure in the Harper patent is intended to overcome the problem of stretching of the tubular member during the squeezing thereof. More specifically, Harper discloses a flexible tubular member and first reciprocating means for sealing off a portion of the tubular member from the inlet conduit thereof. Second reciprocating means are spaced from the first reciprocating means for sealing off a portion of the tubular member from the discharge conduit. Third reciprocating means engage the tubular member to alternately decrease and increase the capacity thereof between the sealing means. Harper does not suggest that the third reciprocating means is responsive, in timed relationship, to the movement of the first and second reciprocating means as is taught by the present invention which will be described more fully hereinafter.

Still another U.S. Pat. No. 3,778,195 granted to Bamberg discloses a pump that includes a shaft driven by a motor and a plurality of cams spaced along the shaft with the cams being angularly and sequentially offset from one another. The cams interact with spring loaded members which, in turn, sequentially squeeze shut a flexible, disposable tubing held in place by support means. Bamberg controls the rate of flow of the fluid through the tubing by an adjusting mechanism which engages the spring loaded members that sequentially compress the tubing and thereby controls the cross sectional flow area of the tubing. Bamberg does not suggest that one cam is responsive to the movement of another cam, as is taught by the present invention.

Still another application of a pump of the type to which the present invention is directed is a heart pump used to pump blood to bypass the blood around a living heart. For example, such heart pumps must be operable without producing turbulence and stagnation of the blood and in addition, at slow pumping rates, cannot produce back flow or regurgitation of the blood resulting in low efficiency fluid transfer. Moreover, at rapid pumping rates, damage to the blood by hemolysis due to rapid and excessive forces applied in the pumping and valving operations must be prevented. In a heart pump it is necessary that violent spurts of the blood are not permitted since this can also result in damage to the blood. Where a chemical mixture or composition of the blood must be determined, it is frequently desirable that the quantity of fluid withdrawn be within closely defined limits and that the apparatus employed permit withdrawal in small precise quantities as well as in larger amounts. For example, drop-by-drop extraction under complete control of the operator is very frequently a matter of considerable importance in some medical, scientific and manufacturing operations. When used as an extracorporeal heart, the pump must be capable of immediate adjustment upon any change in the flow characteristics of the vascular system. When used as an artifical heart, the pump will affect the vascular flow and a complex, virtually uncontrollable feed-back relation exists between the artificial heart and the vascular system of the subject. For example, during open heart surgery, a technician is continually instructed by the surgeon as to the starting, stopping and adjustment of the pump operations. A difficult, coordinated effort is required. Continuous monitoring is necessary. It is therefore essential that the pump be capable of delivering a wide range of quantities for long periods of time.

SUMMARY OF THE INVENTION

The present invention relates to a precision metering and precision dispensing pump for various types of fluids. In particular, the present invention is especially adapted to handle very small quantities of fluids although it can be scaled to any reasonable size. In addition, the present invention can handle corrosive or volatile liquids. The pump of the present is also capable of sterilization so that the liquid path is free from organic contamination. The present invention is thereby suitable for biological purposes. Of particular importance is the fact that the quantity of liquid that is dispensed can be adjusted over a considerable range while the present invention is operating.

The present invention, under actual tests has proven capable of pumping material ranging in viscosity from light alcohol to heavy grease, all with high accuracy. Sulphuric acid, acetic acid, hydrocarbons and other volatile and corrosive materials have been successfully pumped by the present invention. The dispensed quantities under actual tests of the present invention range from a low of about 25 microliters per stroke to a high of about 0.5mm per stroke, although there is really no upper limit. Reliability has been demonstrated as approximately +2% for a single stroke, +1% for two strokes and better than 0.25% for five or more strokes. The present invention lends itself to digital control whereby different delivered quantities can be simply controlled. This feature is valuable for dillution to high precision and for formulation of mixtures involving ratios of components. The present invention may also be constructed as a dual dispenser in which two separate pumping tubes are actuated by a single mechanical system, in order to ensure correct ratios of two fluids delivered at once. Life testing has shown that with readily available elastomers, pumping tubes for use with corrosive fluids, such as concentrated sulphuric acid, will last for more than 200,000 operating cycles. As will be explained more fully hereinafter, an important feature of the present invention is the fact that the outlet valve is shut off from the inlet valve at all times during the cycle so as to obviate the need for still other valves to control the fluid flow when the pump is deactivated.

In its broadest aspect, the present invention provides a housing in which elongated elastomeric tubing means is supported. The tubing means includes an inlet end adapted to be connected to a source of a fluid to be pumped and an outlet end. The present invention provides three plungers that are adapted to apply compression forces to the tubing means. There is an inlet plunger, an extruder pump plunger and an outlet plunger all of which are arranged serially in opposition to and along the length of the tubing means. A linear actuator such as a motor drive, a solenoid or other form of mechanical, electrical or pneumatic device is rigidly coupled to a two sectioned primary cam by means of a link so that the primary cam is linearly movable in response to the output of the actuator. The primary cam controls the displacement, in a timed relationship, of the inlet and outlet plungers. The extruder plunger is responsive to a secondary cam which is, in turn, linearly movable in response to the linear movement of the primary cam.

In operation the linear actuator drives a cam slide to one extreme position wherein the extruder and the inlet plungers are placed in a retracted or in a non-force applying position by coacting cams while at the same time outlet plunger is extended by a cam and compresses the elastomeric tube so as to prevent the discharge of any fluid. In line with each of the plungers and adjacent the elastomeric tube is a plug which is threaded into the cover of the housing in order to provide an adjustability for the elastomeric tube by the individual plungers. Normal adjustment is obtained when the inlet and outlet plungers cause complete closure of the elastomeric tube and the extruder plunger compresses the elastomeric tube but does not quite close it in an actuated position. The elastomeric tube is connected to a low pressure fluid source. Since the present invention constitutes a positive displacement system there is no particular limit on fluid pressure in either direction except to prevent either collapse or ballooning of the elastomeric tube.

Fluid will flow into the tube up to the point where the outlet plunger has sealed it off. Upon initial actuation of the sliding cam by means of the linear actuator, the main or primary cam will cause the inlet plunger to close the tube thereby momentarily creating an increase in pressure in the fluid that is trapped between the outlet plunger and the inlet plunger. The secondary cam will not have yet moved because of the physical relationship between the primary and secondary cams. That is, the primary cam includes a cutout along which the secondary cam may move. The cutout is greater in length that the length of the secondary cam. When the primary cam moves a predetermined distance, one end face of the cutout in the primary cam will strike the secondary cam shortly after both the inlet valve and the outlet valve are closed thereby forcing the secondary cam to cause the extruder plunger to move into engagement with the elastomeric tube. At the same time the outlet plunger retracts thereby opening the fluid passage to the outlet. The secondary cam forces the extruder plunger upward thereby pinching the tube and extruding the material in the tube through the outlet. The linear actuator may now be reversed returning it to its original position. Since the space that initially existed between the ends of the cutout in the primary cam and the end faces of the secondary cam are now in a position opposite to the original position, the primary cam will move for a distance equivalent to the space before engaging the secondary cam. This movement causes the outlet plunger to occlude the elastomeric tube while the extruder plunger is still activated. After closure of the outlet valve by means of movement of the outlet plunger, the inlet valve is opened while the extruder plunger is still activated. After closure of the outlet valve the inlet valve is opened while the extruder plunger is retracted. This causes the fluid under pressure to fill the tube and return to the initial state.

It will be appreciated that the fluid inlet need not be under pressure if the elastomeric tube is elastic. In such a case, the return to shape of the tube increases the volume of the tube causing a reduction in pressure in the inlet line. Atmospheric air pressure will then force fluid into the pump tube. Where a completely flexible but inelastic pumping tube is used, some pressure is needed at the inlet to refill the pump tube after a delivery cycle.

As mentioned above, a dual dispenser of the type just described may be provided in which two separate pumping tubes are actuated by a single mechanical system. The purpose of a dual dispenser is to ensure correct ratios of two fluids being delivered at once. Regardless of whether one, two, or more dispensers are utilized, an important feature of the present invention is the fact that the outlet is shut off from the inlet at all times during the cycle. This construction obviates the need for additional valves to control flow when the pump is deactivated.

Accordingly, it is an object of the present invention to provide an improved, peristaltic pump of the type described hereinabove.

Another important object of the present invention is to provide a novel and improved method for operating a peristaltic pump of the type described hereinabove.

These and other objects, features and advantages of the invention will, in part, be pointed out with particularity, and will, in part, become obvious from the following more detailed description of the invention, taken in conjunction with the accompanying drawing, which forms an integral part thereof.

BRIEF DESCRIPTION OF THE DRAWING

In the various figures of the drawing, like reference characters designate like parts.

In the Drawing.

DESCRIPTION OF THE PREFERRED EMBODIMENT

Figure 1:
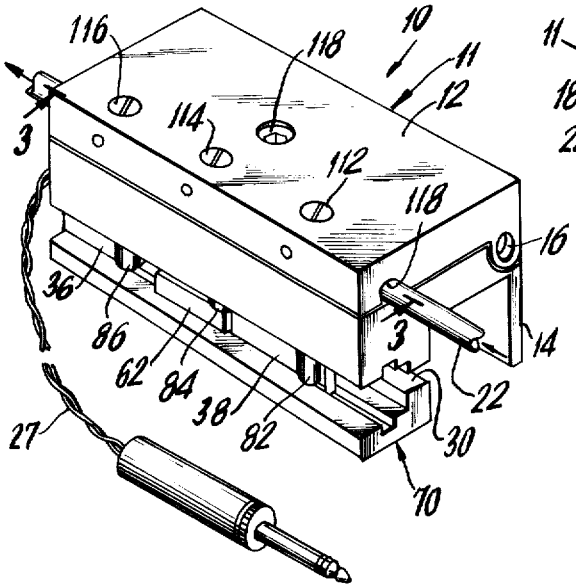
FIG. 1 is a perspective view illustrating one embodiment of the present invention.

In FIG. 1 there is illustrated one embodiment of the peristaltic pump 10 comprising the present invention. The housing 11 includes a cover portion 12 and a base portion 14 which are hingedly connected to each other by means of a pin 16. The cover portion 12 has an arcuate cutout 18 extending from one end thereof to the other and the base portion 14 has a mating confronting cutout 20 formed therein and extending from one end thereof to the other. With the cover 12 in the closed position, such as shown in FIG. 1, an elastomeric tube 22 is positioned within cutouts 18 and 20. For purposes of orientation the inlet end of the tube 22 is at the right side in FIGS. 1 and 3 and the dispensing end of the tube 22 is at the left hand side with the flow of the fluid being from right to left. The fluid inlet need not be under pressure if the tube 22 is elastic. In such a case, the return to shape of the tube 22 increases the volume thereof causing a reduction in pressure in the inlet line. Atmospheric air will then force fluid into the tube 22. Where a completely flexible but inelastic pumping tube 22 is used some pressure is needed at the inlet to refill tube 22 after a delivery cycle.

The tube 22 must have excellent fatigue resistance as well as be resistant to attack by the chemicals for which the pump is used. One material which has been employed for the tube is silicone rubber. Other generally suitable tube materials include "Technicon Acidflex" and "Technicon Solvaslex" as supplied by the Technicon Corp. of Tarrytown, N.Y.

Figure 2:
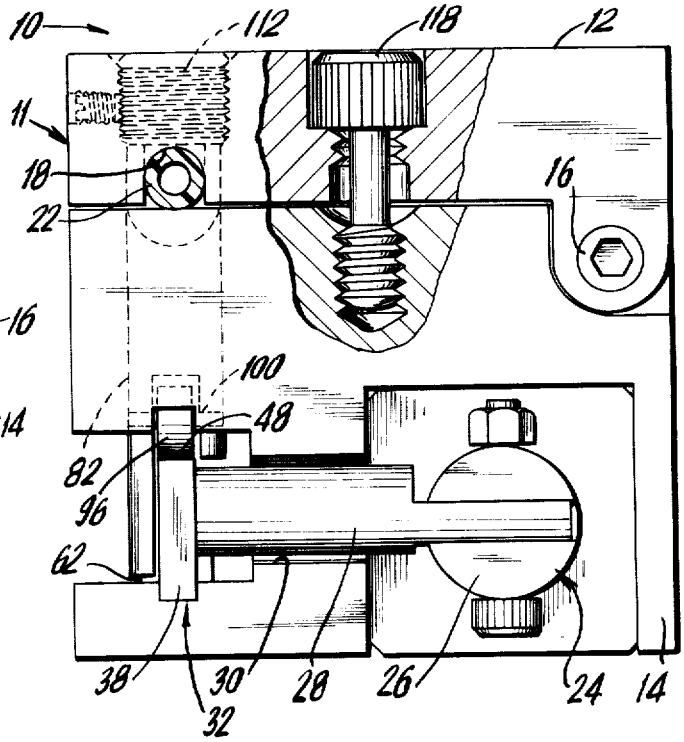
FIG. 2 is an end elevational view of the structure shown in FIG. 1.

As shown in FIG. 2 a linear actuator 24 having a piston 26 is mounted in the base portion 14 of the housing 11 and is provided with a rigid link 28. The actuator, in the embodiment illustrated, is a pneumatic actuator 24 that may be controlled by electrically actuated solenoid valve 25. Electrical control signals are provided through conductor 27. However, it should be understood that any form of linear actuator may be employed such as a motor drive, a solenoid, or other form of mechanical, electrical or pneumatic device in order to produce translational movement. The rigid link 28 extends through a slot 30 in the base portion 14 of the housing 11 and the slot 30 extends in an axial direction that is parallel to the direction of the length of the tube 22.

Figure 3:
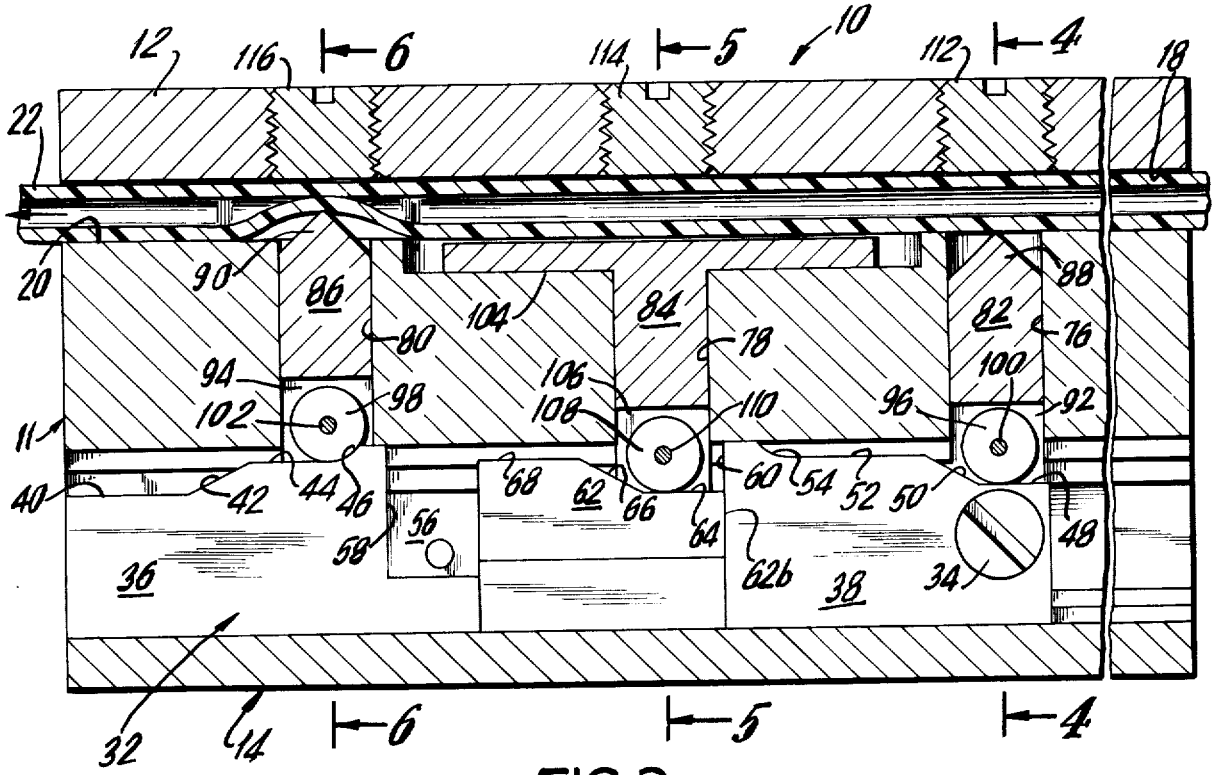
FIG. 3 is a longitudinal sectional elevational view taken along line 3—3 of FIG. 1.
Figure 4:
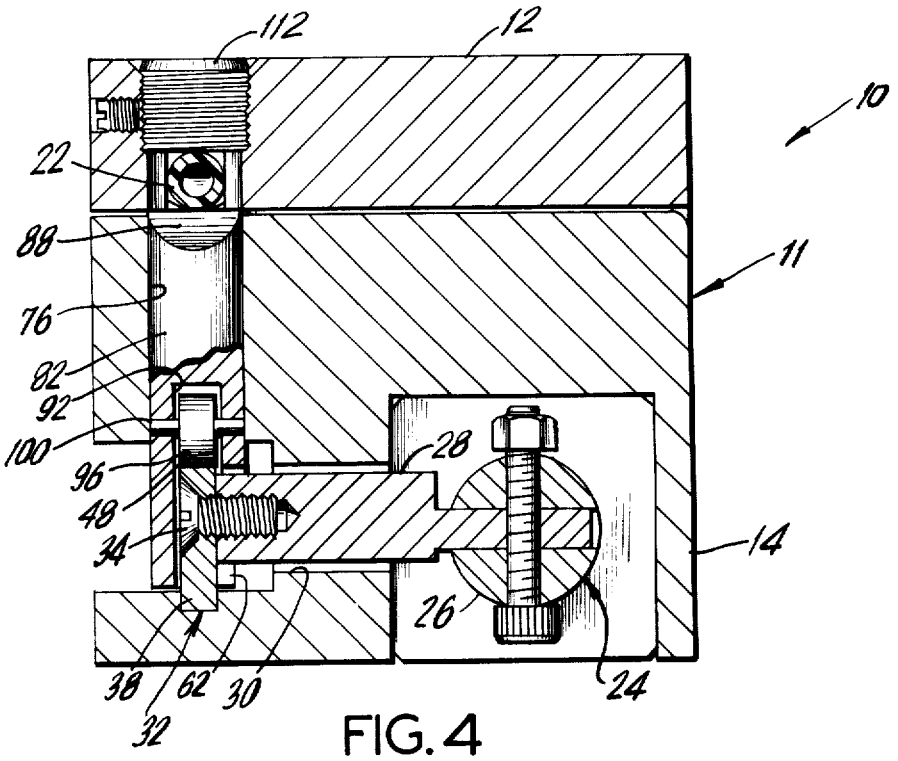
FIG. 4 is a transverse sectional elevational view taken along line 4—4 of FIG. 3.

Turning now particularly to FIGS. 2–4, it will be seen that the link 28 is rigidly secured to a slideable, primary cam 32 by means of a set screw 34. The primary cam 32 is comprised of axially spaced apart sections 36 and 38 with the cam section 36 being responsible for the outlet function of the present device and with the cam section 38 being responsible for the inlet function of the present invention. The cam section 36 is provided with consecutive cam surfaces 40, 42 and 44 with the cam surfaces 40 and 44 being parallel to and spaced apart from each other in different planes and connected by the cam surface 42 which is intermediate thereof and inclined with respect thereto. The cam section 36 also has an end stop 46 the function of which, together with the function of the surfaces 40, 42 and 44 will be described hereinafter. Similarly, the cam section 38 of the primary cam 32 is provided with cam surfaces 48, 50 and 52. The cam surfaces 48 and 52 are parallel to and spaced apart from each other in different planes and are connected by the cam surface 50 which is inclined. As with the first cam section 36, the second cam section 38 also has an end stop 54 whose function will be described hereinafter in connection with the cam surfaces 48, 50 and 52. It should be further noted that the primary cam 32 is provided with a cutout 56 which is defined by axially spaced apart end walls 58 and 60.

A secondary cam 62 is slideably mounted on the primary cam 32 within the cutout 56 and confined by the end walls 58 and 60 of the cutout 56. The secondary cam 62 also includes cam surfaces 64, 66 and 68. The cam surfaces 64 and 68 are parallel to and spaced apart from each other in different planes and are connected by the intermediate cam surface 66 which is in an inclined plane. The cams 32 and 62 are arranged to slide within the confines of guide members 70 when the primary cam 32 is actuated by the link 28 and when the secondary cam 62 is actuated by the primary cam 32 in a manner to be described more fully hereinafter.

The base portion 14 of the housing 11 is provided, as shown best in FIGS. 3 - 6, with three openings 76, 78 and 80 which are related to the inlet, the extruding and the outlet functions, respectively, of the present invention as will be described more fully hereinafter. Inlet, extruder and outlet plungers 82, 84 and 86, respectively, are contained within the openings 76, 78 and 80, respectively, and are arranged to move up and down as shown in FIGS. 3 - 6, in response to the movement of the primary cam 32 and the secondary cam 62.

The inlet and the outlet plungers 82 and 86 are provided with relatively sharp upper ends 88 and 90, respectively, which are arranged to bear against the tube 22 in response to the movement of the primary cam 32. The lower end of the inlet and the outlet plungers 82 and 86 are slotted as shown by the reference characters 92 and 94, respectively. The cam rollers 96 and 98 are journaled on pins 100 and 102, respectively, so that the cam rollers 96 and 98 may ride on the cam surfaces 48, 50, 52 and 40, 42, 44, respectively when the primary cam 32 is linearly displaced by the actuator 24 and the link 28.

Figure 5:
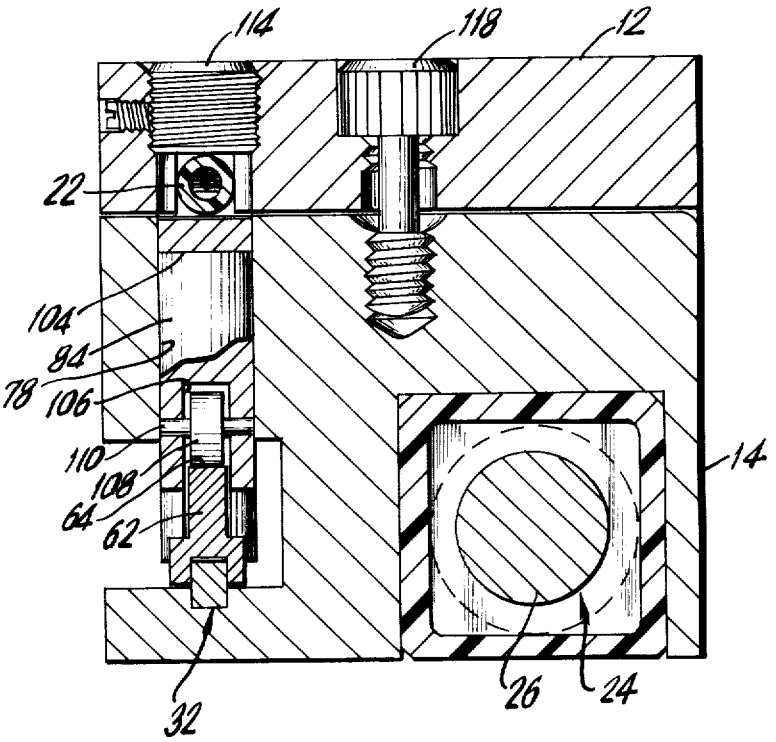
FIG. 5 is a transverse sectional elevational view taken along line 5—5 of FIG. 3.
Figure 6:
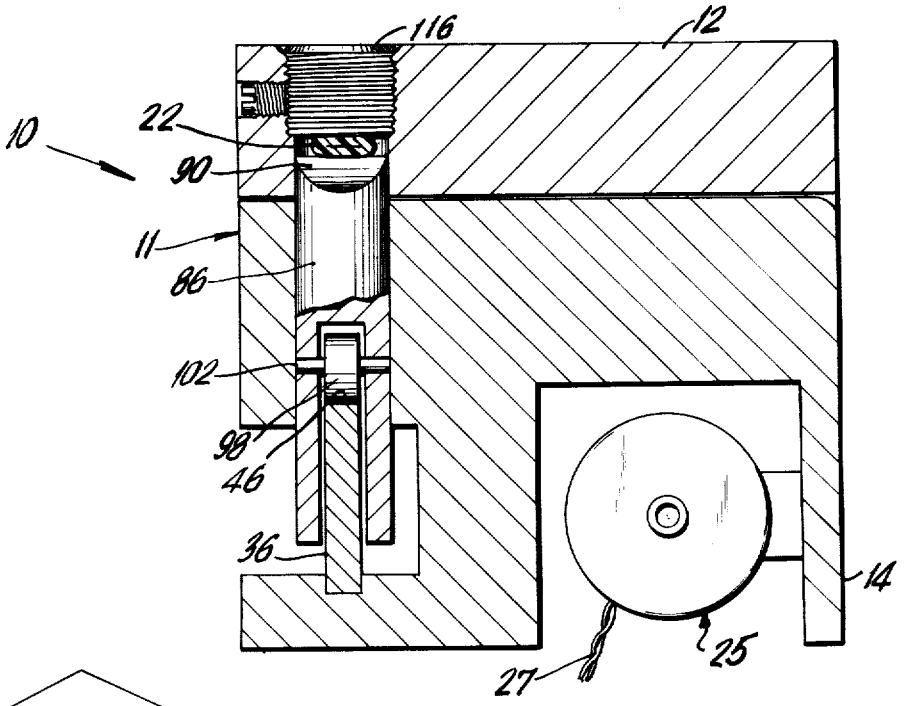
FIG. 6 is a transverse sectional elevational view taken along line 6—6 of FIG. 3.
Figure 7:
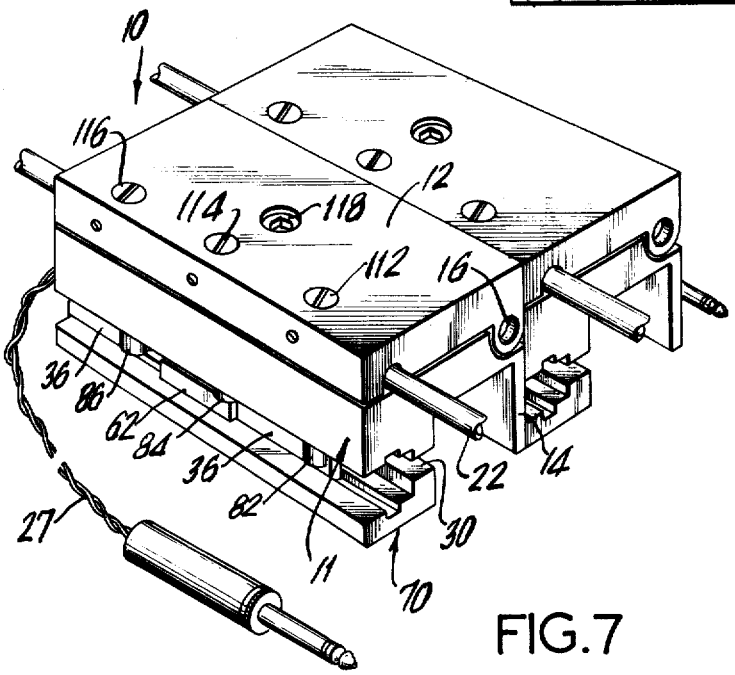
FIG. 7 is a schematic perspective view illustrating a dual dispenser constructed according to the present invention.

The extruder plunger 84 is provided with an enlarged transversely flat upper end 104 which bears against the tube 22 as shown best in FIGS. 3 and 5. The lower end of the extruder plunger 84 is slotted such as shown by the reference character 106 in order to receive a cam roller 108 which is journaled therein by means of a pin 110 so that the extruder plunger 84 is responsive to the movement of the secondary cam 62 in a manner to be described more fully hereinafter.

The inlet, extruder and outlet plungers 82, 84 and 86 are arranged to move linearly within the openings 76, 78, and 80, respectively, and substantially perpendicularly to the direction of movement of the primary and secondary cams 32 and 62, respectively.

In line with each of the plungers 82, 84 and 86 are plugs 112, 114 and 116, respectively, which are threaded into the cover 12 of the housing 11. The lower or inner end of each of the plugs 112, 114 and 116 bears against the outside surface of the tube 22. The plugs 112, 114 and 116 provide adjustability for the pinching of the elastomeric tube by the individual plungers 82, 84 and 86. Normal adjustment is obtained when the plungers 82 and 86 cause complete closure of the tube 22 and the plunger 84 compresses the tube 22 but does not quite close it in the actuated position. A screw 118 (FIGS. 1 and 2) secures the cover 12 to the base portion 14 of the housing 11.

The method comprising the present invention may be derived from the structure just described. In the "at rest" position shown in FIG. 3 the linear actuator 24 drives the primary cam 32 to its extreme left hand position. In this position the inlet and the extruder plungers 82, and 84 are both retracted or in their lowest position and the outlet plunger 86 is extended to its uppermost position in order to cause a local constriction of the tube 22. The right hand end of the tube 22 is connected to the source of low fluid pressure. The tube 22 will fill up with fluid up to the point where the plunger 86 has constricted the tube 22. Upon actuation of the primary cam 32 to the right as shown in FIG. 3 the primary cam section 38 will cause the inlet plunger 82 to move upwardly since the roller 90 thereof rides successively on the first cam surface 48, then on inclined cam 50 and finally on the cam surface 52 in order to close the tube 22. This action momentarily creates an increase in pressure in the fluid trapped between the inlet and outlet plungers 82 and 86. The secondary cam 62 has not yet moved because of the slotted cutout 56 in the primary cam 32. The left hand face 58 of the primary cam 32 (FIG. 3) strikes the left hand end **62*a* of the secondary cam 62 shortly after the inlet and the outlet plungers 82 and 86 close the tube 22 as described hereinabove. This action causes the stationary cam 62 to move to the right. At the same time the outlet plunger 86 is retracting because the roller 98 moves from the cam surface 44 through the cam surface 42 and onto the cam surface 40 thereby opening the fluid passage of the tube 22 to the outlet. At the same time, the extruder plunger 84 is being forced upwardly because the roller 108 thereof rides successively from the cam surface 64 onto the cam surface 66 and then onto the cam surface 68. The upper end 104 of the extruder plunger 84 will thereby pinch the tube 22 and extrude the material in the tube 22** through the outlet.

The actuator 24 will then be reversed returning to its original position. Since the space between the end face **62*b* of the secondary cam 62 and the end face 60 of the cam section 38 will now be on the right side (FIG. 3**)

the primary cam 32 is capable of moving a distance equal to the space before engaging the secondary cam 62. This causes the outlet plunger 86 to occlude the tube 22 while the extruder plunger 84 is still activated. After closure of the tube 22 by means of the outlet plunger 86, the inlet plunger 82 retracts in order to open the inlet end of the tube 22 so as to cause the fluid under pressure to fill the tube 22 and return to the initial state.

From the foregoing it will be appreciated that an important feature of the present invention is the fact that the outlet is shut off from the inlet at all times during the cycle so as to obviate the need for additional valves to control flow when the pump is deactivated. That is, starting from an initial position where the outlet plunger 86 closes the tube 22 in order to fill the tube 22 with fluid, the outlet plunger 86 is first retracted while the extruder plunger 84 is being extended and before the inlet plunger 82 is retracted. This mode of operation results from the relationship of the primary cam section 36 with respect to the secondary cam 62 and with relationship of the primary cam section 36 with the primary cam section 38.

There has been disclosed heretofore the best embodiment of the invention presently contemplated. However, it is to be understood that various changes and modifications may be thereto without departing from the spirit of the invention.

What is claimed is:

1. A peristaltic-type metering pump comprising:

a. a housing;

b. elongated tubing means supported in said housing, said tubing means including an inlet end adapted to be connected to a source of fluid to be pumped and an outlet end;

c. an inlet plunger, an extruder plunger and an outlet plunger arranged serially in said housing in opposition to and along the length of said tubing means in said housing, said inlet, extruder, and outlet plungers being further arranged to be displaced and to thereby apply compressive forces to said tubing means;

d. a linear actuator;

e. primary cam means slidably mounted in said housing and responsive to said linear actuator for displacing said inlet and said outlet plungers in a predetermined timed relationship with respect to each other to thereby apply said forces to said tubing means, said primary cam means being comprised of first and second axially spaced apart sections; and f. secondary cam means located between said first and second sections responsive to the movement of said first cam means for displacing said extruder plunger in a predetermined time relationship with respect to the displacement of said inlet and outlet plungers, said secondary cam means being slidably mounted on said primary cam means and arranged to be displaced in one axial direction by a portion of one of said primary cam means sections and to be displaced in the opposite axial direction by the other of said primary cam means sections.

2. The pump according to claim 1 wherein said primary cam means sections each include a pair of parallel cam surfaces that are spaced apart in the direction of movement of said inlet and outlet plungers with said cam surfaces of each said primary cam means sections being connected by an intermediate cam surface, said intermediate cam surfaces being inclined in opposite directions.

3. The pump according to claim 2 wherein said secondary cam means includes a pair of parallel cam surfaces that are spaced apart in the direction of movement of said extruder plunger with said cam surfaces of said secondary cam means being connected by an intermediate cam surface that is inclined in the same direction as said inclined intermediate cam surface of said primary cam means section that displaces said inlet plunger.

4. The pump according to claim 2 wherein said inlet and outlet plungers each includes cam follower means arranged to successively engage said cam surfaces of said respective primary cam means sections.

5. The pump according to claim 3 wherein said extruder plunger includes cam follower means arranged to successively engage said cam surfaces of said secondary cam means.

* * * * *